US008690643B2

(12) United States Patent
Vallee et al.

(10) Patent No.: US 8,690,643 B2
(45) Date of Patent: Apr. 8, 2014

(54) PORTABLE DRILL BIT SHARPENER

(75) Inventors: Glenn E. Vallee, Westbrook, CT (US); James C. McKeon, Longmeadow, MA (US); Eric D. Perkins, Longmeadow, MA (US); Gregory J. O'Brien, Granville, NY (US); Daniel James Goodwin, Cutchogue, NY (US); Nicholas W. Kantany, Holden, MA (US)

(73) Assignee: Western New England University, Spingfield, MA (US)

( * ) Notice: Subject to any disclaimer, the term of this patent is extended or adjusted under 35 U.S.C. 154(b) by 424 days.

(21) Appl. No.: 13/176,978

(22) Filed: Jul. 6, 2011

(65) Prior Publication Data

US 2012/0009853 A1 Jan. 12, 2012

Related U.S. Application Data

(60) Provisional application No. 61/398,969, filed on Jul. 6, 2010.

(51) Int. Cl.
*B24B 23/02* (2006.01)

(52) U.S. Cl.
USPC ..... 451/359; 451/363; 451/375

(58) Field of Classification Search
USPC ..... 76/5.1, 108.1, 108.2, 108.6; 451/48, 49, 451/358, 359, 360, 363, 375
See application file for complete search history.

(56) References Cited

U.S. PATENT DOCUMENTS

| | | | | | |
|---|---|---|---|---|---|
| 3,224,146 | A * | 12/1965 | Ahlstrom | ..... | 451/211 |
| 3,698,140 | A * | 10/1972 | Steadman | ..... | 451/438 |
| 3,742,652 | A * | 7/1973 | Enders | ..... | 451/180 |
| 4,744,178 | A * | 5/1988 | Afshar | ..... | 451/438 |
| 5,210,977 | A * | 5/1993 | Werner | ..... | 451/283 |
| 5,676,591 | A * | 10/1997 | Huang | ..... | 451/359 |
| 6,116,995 | A * | 9/2000 | Chao | ..... | 451/351 |
| 6,257,967 | B1 * | 7/2001 | Schultz | ..... | 451/349 |
| 6,676,500 | B1 * | 1/2004 | Lin | ..... | 451/359 |
| 7,077,736 | B2 * | 7/2006 | Uzumcu et al. | ..... | 451/359 |

* cited by examiner

*Primary Examiner* — Timothy V Eley
(74) *Attorney, Agent, or Firm* — Cantor Coulburn LLP

(57) ABSTRACT

A hand held, portable drill bit sharpener is provided which may be powered by a standard commercially available electrical power tool. The power tool may be used to actuate the drill bit sharpener by arranging the drive shaft of the sharpener into the power tool chuck. This drive shaft is connected through a gear set to a biased rotating sharpening stone which is pressed against a drill bit tip. The drill bit may be held in the sharpener using a standard keyless drill bit chuck.

20 Claims, 2 Drawing Sheets

PORTABLE DRILL BIT SHARPENER

CROSS REFERENCE TO RELATED APPLICATIONS (IF APPLICABLE)

This application claims priority to U.S. Provisional Application Ser. No. 61/398,969 filed Jul. 6, 2010 which is incorporated by reference herein in its entirety.

BACKGROUND OF THE INVENTION

The subject matter disclosed herein relates to a drill bit sharpener and in particular to a drill bit sharpener that may be powered by a standard electrical power tool.

Professional carpenters and other construction professionals, as well as do-it-yourselfers, are often confronted with a drill bit becoming dull or even breaking with use. Once a drill bit is dulled, jobs cannot be completed as quickly, or with the same degree of quality as before. To avoid this situation the user has two options: The dulled or broken drill bit can be thrown away and a new drill bit purchased or the drill bit can be resharpened and used again.

The first option is wasteful, expensive and requires an inventory of drill bits be maintained, increasing operating costs for the operator. The resharpening option has the advantage of reusing drill bits many times and extending the useful life of a drill bit. However, drill bit sharpening tools tend to be stand-alone units that may be very expensive and are not easily accessible on a jobsite or in a remote work environment. This results in the drill user having to leave the job site, wasting time and reducing the worker's productivity.

Accordingly, while existing drill bit sharpeners are suitable for their intended purposes the need for improvement remains, particularly in providing a low cost, easy-to-use, portable, drill bit sharpening tool that may be easily transported to and about a job site.

BRIEF DESCRIPTION OF THE INVENTION

According to one aspect of the invention, a sharpener is provided. The sharpener includes a case having a shaft extending from a first end of the case, the shaft having a first end sized to couple with an electrical power tool. A gear train is coupled to the shaft. A grinding stone is operably coupled to the gear train, the grinding stone having a conical recess on one side. A drill chuck is coupled to the case opposite the shaft, the drill chuck being substantially axially aligned with the conical recess.

According to another aspect of the invention, another sharpener is provided. The sharpener includes a case having a hollow interior area. A shaft extends from a first end of the case, the shaft having a first end sized to couple with an electrical power tool. A first gear train is disposed within the hollow interior area and coupled to the shaft. A second gear train is disposed within the hollow interior area and coupled to the first gear train. A grinding stone is operably coupled to the second gear train, the grinding stone having a conical recess a side opposite the second gear train. A drill chuck is coupled to the case opposite the shaft, the drill chuck being substantially axially aligned with the conical recess.

According to yet another aspect of the invention, yet another sharpener is provided. The sharpener includes a case having a hollow interior area. A shaft extends from a first end of the case, the shaft having a first end sized to couple with an electrical power tool. A first gear train is disposed within the hollow interior area and coupled to the shaft. A second gear train is disposed within the hollow interior area and coupled to the first gear train. A grinding stone is operably coupled to the second gear train, the grinding stone having a conical recess a side opposite the second gear train. A drill chuck is coupled to the case opposite the shaft, the drill chuck being substantially axially aligned with the conical recess. A slip collar is coupled for axial movement to the case, the slip collar being disposed between the grinding stone and the drill chuck. A spring is arranged within the hollow interior area to bias the grinding stone towards the slip collar.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Drill bits, such as those used with electrical power tools are subjected to large amounts of wear during use. As a result, the drill bits will become worn or dull after a period of use, causing the operator to replace the drill bit or re-sharpen the bit edges. Embodiments of the invention provide a drill bit sharpener that is portable and may be readily transported, such as in a tool box or in a tool belt for example, to a desired operating location. The drill bit sharpener is configured to removably couple with an electrical power tool, which may be used to actuate the sharpener. Embodiments of the invention provide advantages in allowing an operator to quickly and easily re-sharpen a drill bit without having to leave the area where the work is being performed.

Figure 1:
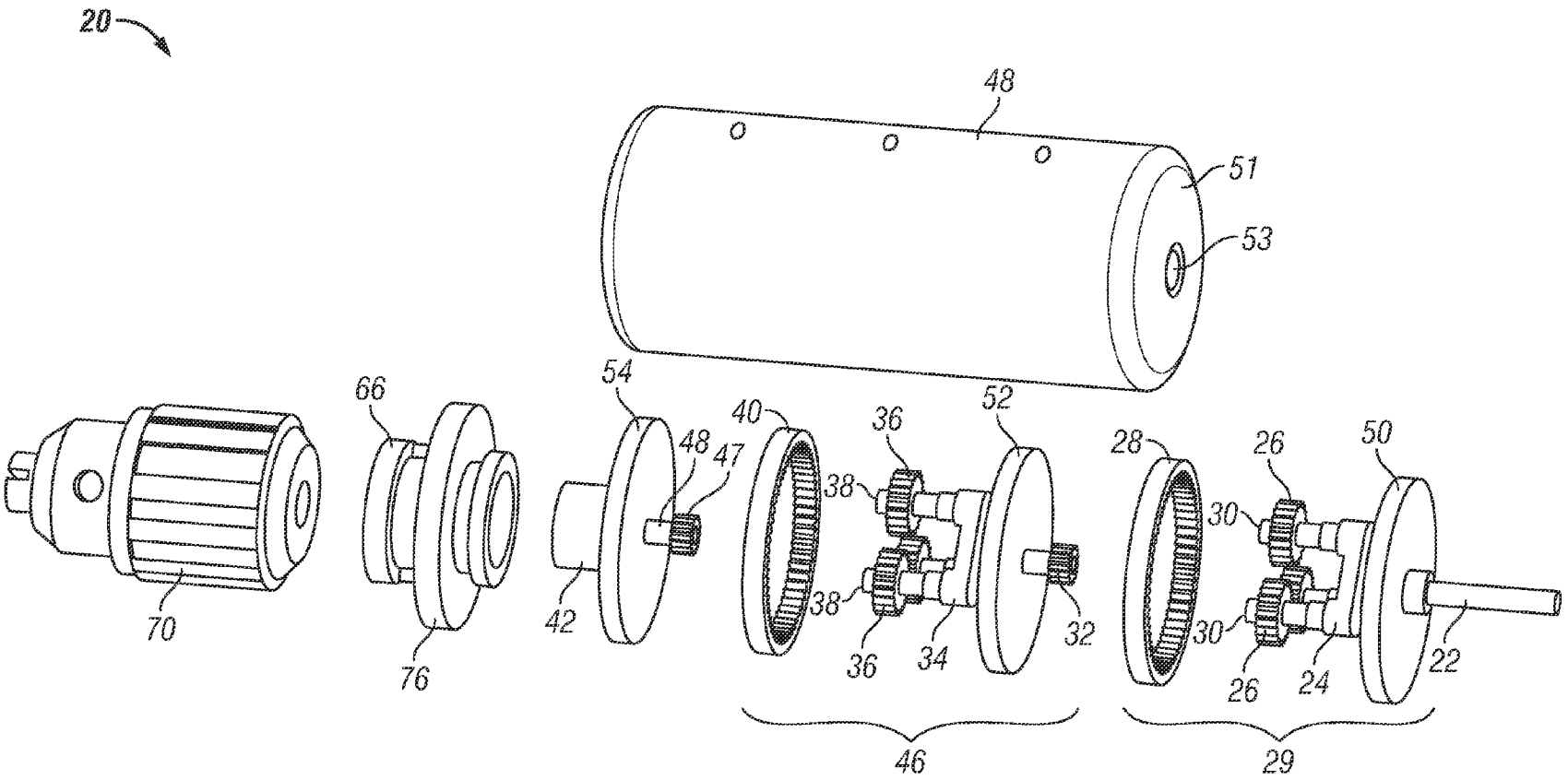
FIG. 1 is an exploded view of a drill bit sharpener in accordance with an embodiment of the invention.

Referring to FIG. 1, a drill bit sharpener 20 is shown that is arranged to couple with, and be actuated by, an electric power tool (not shown), such as a corded or cordless electric drill. The drill bit sharpener 20 includes an input shaft 22 that is sized to be received in a standard electrical drill chuck (not shown). An opposite end of the shaft 22 is coupled to a first planetary hub 24 having a plurality of first planet gears 26. In the exemplary embodiment, the first planetary hub 24 has three first planet gears 26. The first planet gears 26 rotate within a ring gear 28. The first planetary hub 24, first planet gears 26 and ring gear 28 define a first gear train 29

Figure 2:
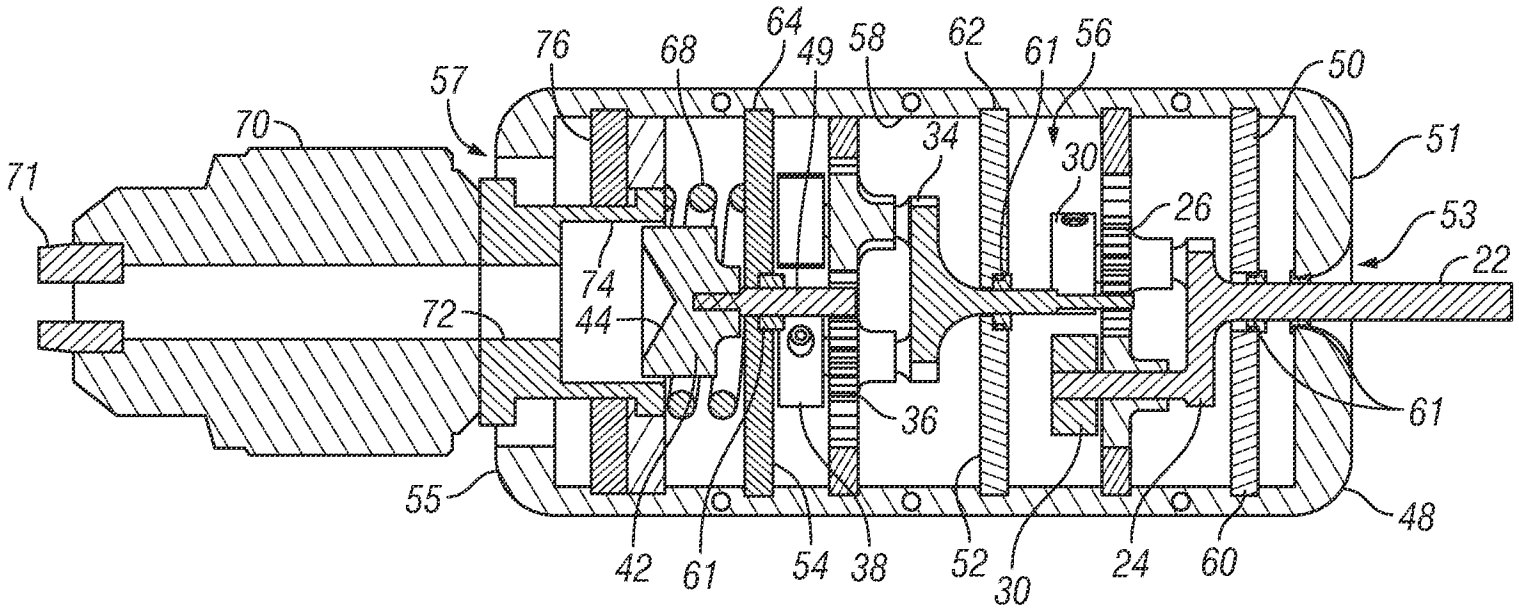
FIG. 2 is a side sectional view of the drill bit sharpener of FIG. 1.

The first planet gears 26 are retained on the first planetary hub 24 by retaining collars 30. The first planet gears 26 rotate a sun gear 32 that is coupled to a second planetary hub 34. The second planetary hub 34 has a plurality of second planet gears 36. In the exemplary embodiment, the sharpener 20 has three second planet gears 36 which are retained on the second planetary hub 34 by collars 38. The second planet gears 36 rotate within a second sun gear 40. The second planetary hub 34, second planet gears 36 and second sun gear 40 define a second gear train 46. The second sun gear 47 is connected to a grinding stone 42 that is used to grind a desired profile onto the drill bit. The grind stone 42 may include a conical recess 44 (FIG. 2) that is sized to receive the end of the drill bit. The angle of the conical recess 44 will depend on the point angle of the drill bit being sharpened. In some embodiments, the grind stone 42 is removably coupled to the second sun gear 47 to allow different drill bits to be sharpened. In the exemplary embodiment, the angle of the conical recess 44 may be between 60 to 135 degrees.

The second planet gears 36 rotate a second sun gear 47. The second sun gear 47 is connected to the grinding stone 42 by a shaft 49. In the exemplary embodiment, each of the gear trains 29, 46 develop a gear ratio of 18:1. This results in a total speed increase of 36 times the input power tool speed.

The gear trains 29, 46 are mounted within a case 48 by a plurality of bearing supports 50, 52, 54. Each of the bearing supports 50, 52, 54 may have a bearing, such as a ball-bearing 61. The case 48 has a first end 51 having an opening 53. The opening 53 is sized to allow the shaft 22 to exit the case 48. On a second end 55, the case 48 has a second opening 57 sized to receive a slip collar 66. In one embodiment, the case 48 has a generally hollow interior area 56 defined by an inner wall 58. A plurality of circumferential grooves 60, 62, 64 may be formed on the inner wall 58. The grooves 60, 62, 64 are sized to receive and retain the bearing supports 50, 52, 54 within the interior area 56.

The grinding stone 42 is arranged between a slip collar 66 and bearing support 54. A biasing member, such as spring 68 for example, biases the grinding stone 42 against a drill bit that is held in a drill chuck 70. As is known to those skilled in the art, a drill chuck is a type of clamp used to hold an object with radial symmetry. In the exemplary embodiment, the drill chuck 70 has a plurality of jaws 71 that are arranged in a radially symmetrical pattern to hold the drill bit in place. In some embodiment, the drill chuck 70 may have a keyed or keyless jaw assembly that allows the jaws 71 to be opened or closed for removing and installing the drill bit.

In the exemplary embodiment, the slip collar 66 includes a bore 72 and a counter bore 74. The bores 72, 74 are substantially axially aligned with the conical recess 44. The counter bore 74 is sized to receive at least a portion of the grinding stone 42. The slip collar 66 may also include a flange 76 that engages the inner wall 58 of the case 48 to allow the slip collar to be axially aligned within the case 48. The slip collar 66 allows the drill chuck 70 to translate in a direction parallel to the drill bit. This arrangement provides advantages in improving the alignment between the drill bit and the grinding stone 42.

In operation, the operator couples the shaft 22 to an electrical power tool, such as an electric drill, for example. The drill bit is then inserted into the drill chuck 70, causing the end of the drill bit to contact the grinding stone 42. The jaws 71 of the drill chuck 70 are tightened to hold the drill bit in the sharpener 20. The operator actuates the electrical power tool causing the shaft 22 to rotate. The rotation of the shaft 22 is translated through the gear trains 29, 46 causing the grinding stone 42 to rotate against the end of the drill bit held in the drill chuck 70. The rotation of the grinding stone 42 sharpens the drill bit.

It should be appreciated that while embodiments herein discuss using the sharpener with an electrical drill, this is for exemplary purposes and the claimed invention should not be so limited. The claimed sharpener may be used with any electrical power tool having a rotating element that the shaft of the sharpener may be attached, such as but not limited to a router, a rotary tool, a cordless drill, a corded drill, or a drill press for example.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A sharpener comprising a case;

a shaft extending from a first end of the case, the shaft having a first end sized to couple with an electrical power tool;

a gear train coupled to the shaft;

a grinding stone operably coupled to the gear train, the grinding stone having a conical recess on one side; and a drill chuck coupled to the case opposite the shaft, the drill chuck being substantially axially aligned with the conical recess.

2. The sharpener of claim 1 wherein said gear train comprises:

a first gear train coupled to the shaft, the first gear train having a first hub and a plurality of first planet gears disposed within a first ring gear;

a second gear train coupled to the plurality of first planet gears by a first sun gear, the second gear train having a second hub coupled to the first sun gear and a plurality of second planet gears; and, a second sun gear is coupled between the second planet gears and the grinding stone.

3. The sharpener of claim 1 further comprising:

a slip collar disposed between the drill chuck and the grinding stone; and, a biasing member operably coupled to the grinding stone to bias the grinding stone toward the slip collar.

4. The sharpener of claim 3 wherein the grinding stone is removably coupled to the second sun gear.

5. The sharpener of claim 4 further comprising at least one bearing support coupled between the case and the gear train.

6. A sharpener comprising:

a case having a hollow interior area;

a shaft extending from a first end of the case, the shaft having a first end sized to removably couple with an electrical power tool;

a first gear train disposed within the hollow interior area and coupled to the shaft;

a second gear train disposed within the hollow interior area and coupled to the first gear train;

a grinding stone operably coupled to the second gear train, the grinding stone having a conical recess on a side opposite the second gear train; and a drill chuck coupled to the case opposite the shaft, the drill chuck being substantially axially aligned with the conical recess.

7. The sharpener of claim 6 further comprising a slip collar disposed between the drill chuck and the grinding stone, the slip collar being coupled to the case for axial movement within the hollow interior area.

8. The sharpener of claim 7 wherein the slip collar includes a bore and a counter bore substantially axially aligned with the conical recess.

9. The sharpener of claim 8 wherein the grinding stone is at least partially disposed within the counter bore.

10. The sharpener of claim 7 further comprising a spring disposed within the case and arranged to bias the grinding stone towards the slip collar.

11. The sharpener of claim 6 wherein:

the first gear train includes a first hub and a plurality of first planet gears disposed within a first ring gear;

the second gear train is coupled to the plurality of first planet gears by a first sun gear, the second gear train having a second hub coupled to the first sun gear and a plurality of second planet gears; and, a second sun gear is coupled between the second planet gears and the grinding stone.

12. The sharpener of claim 11 wherein the first gear train and the second gear train have a gear ratio of 18:1.

13. The sharpener of claim 12 wherein the grinding stone is removably coupled to the second sun gear.

14. A sharpener comprising:

a case having a hollow interior area;

a shaft extending from a first end of the case, the shaft having a first end sized to removably couple with an electrical power tool;

a first gear train disposed within the hollow interior area and coupled to the shaft;

a second gear train disposed within the hollow interior area and coupled to the first gear train;

a grinding stone operably coupled to the second gear train, the grinding stone having a conical recess on a side opposite the second gear train;

a drill chuck coupled to the case opposite the shaft, the drill chuck being substantially axially aligned with the conical recess;

a slip collar coupled for axial movement relative to the case, the slip collar being disposed between the grinding stone and the drill chuck; and a spring arranged within the hollow interior area to bias the grinding stone towards the slip collar.

15. The sharpener of claim 14 further comprising:

a first bearing support coupling the first gear train to the case;

a second bearing support coupling the second gear train to the case; and, a third bearing support coupling the grinding stone to the case.

16. The sharpener of claim 15 wherein:

the first bearing support is coupled to the first gear train by a first bearing; and the second bearing support is coupled to the second gear train by a second bearing; and the third bearing support is coupled to the grinding stone by a third bearing.

17. The sharpener of claim 16 wherein:

the first gear train includes a first hub and a plurality of first planet gears disposed within a first ring gear;

the second gear train is coupled to the plurality of first planet gears by a first sun gear, the second gear train having a second hub coupled to the first sun gear and a plurality of second planet gears; and, a second sun gear is coupled between the second planet gears and the grinding stone.

18. The sharpener of claim 14 wherein the first gear train and the second gear train have a gear ratio of 18:1.

19. The sharpener of claim 14 wherein the grinding stone is removably coupled to the second gear train.

20. The sharpener of claim 19 wherein the conical recess has an angle of 60 to 135 degrees.

* * * * *